US005341583A

United States Patent [19]

Hallenbeck

[11] Patent Number: 5,341,583

[45] Date of Patent: Aug. 30, 1994

[54] SPORT OR LEISURE SHOE WITH A CENTRAL CLOSURE

[75] Inventor: Barry Hallenbeck, Nashua, N.H.

[73] Assignee: Tretorn AB, Helsingorg, Sweden

[21] Appl. No.: 64,644

[22] Filed: May 21, 1993

[30] Foreign Application Priority Data

Jul. 22, 1992 [DE] Fed. Rep. of Germany ... 9209867[U]

[51] Int. Cl.[5] ..... A43B 11/00

[52] U.S. Cl. ..... 36/50.1; 36/54

[58] Field of Search ..... 36/50.1, 50.5, 51, 54; 24/712.1, 712.5, 712.9, 713, 71.2, 685 K

[56] References Cited

U.S. PATENT DOCUMENTS

| | | | |
|---|---|---|---|
| 2,109,751 | 3/1938 | Matthias et al. | 36/50.1 |
| 2,345,057 | 3/1944 | Marinetti | 36/50.1 |
| 3,703,775 | 11/1972 | Gatti | 36/50.1 |
| 4,245,408 | 1/1981 | Larsen et al. | 36/50.1 |
| 4,391,049 | 7/1983 | Parisotto | 36/54 |
| 4,660,300 | 4/1987 | Morell et al. | 36/50.5 |
| 4,726,126 | 2/1988 | Bernhard . | |
| 4,727,660 | 3/1988 | Bernhard . | |
| 4,999,889 | 3/1991 | LeCouturer | 24/713.2 |
| 5,177,882 | 1/1993 | Berger | 36/50.1 |
| 5,181,331 | 1/1993 | Berger | 36/50.1 |

*Primary Examiner*—Paul T. Sewell
*Assistant Examiner*—Marie Denise Patterson
*Attorney, Agent, or Firm*—Sixbey, Friedman, Leedom & Ferguson

[57] ABSTRACT

Shoes, especially sport or leisure shoes, preferably for team sports or for group leisure play, with a central rotary closure which, as much as possible, is not present in preferred kicking areas of such shoes while still being in a location where it can be easily and conveniently operated. In accordance with preferred embodiments, the central rotary closure is located on an upper outer (lateral) side in an area surrounding the lateral side of the ankle. With the central rotary closure so located, advantageously, the tightening element runs from the central rotary closure, alternately between guide elements on the instep cover and lateral side part of the upper toward the toe area of the shoe, across the instep in the metatarsophalangeal joint area and then runs upwardly on the other (medial) side of the upper, alternating between guide elements on the instep cover and medial side part of the upper. The distal end of the tightening element may be attached to the upper material in the area of inner (medial) side of the ankle, or the tightening element can be run around the heel portion of the upper where the distal end of the tightening element may be returned to the central rotary closure and attached to the upper in the area of the central rotary closure or coupled with the central rotary closure.

21 Claims, 2 Drawing Sheets

SPORT OR LEISURE SHOE WITH A CENTRAL CLOSURE

BACKGROUND OF THE INVENTION

This invention relates to a shoe, especially sport or leisure shoe, with an upper that is at least partially formed of an elastically flexible material which extends, on both sides, at least up to the ankle (¾ height), and especially those where the upper covers or rises upwardly above the ankle (high top), with an instep cover that is movable like a tongue, or forms at least part of the tongue, and with a central rotary closure coupled with a tightening element, and by which the length of the tightening element can be wound for closing the shoe and can be extended for opening the shoe, the tightening element alternately guided between guide elements on side parts of the upper and on the instep cover.

Such a shoe is known, for example, from U.S. Pat. No. 5,181,331. In this shoe, the central rotary closure is placed on the instep cover. The sport, leisure, or rehabilitation shoes disclosed in this patent have already proven to be reliable, in practice, to a great extent.

SUMMARY OF THE INVENTION

The primary object to be achieved by the present invention is to provide shoes, especially sport or leisure shoes, preferably for team sports or for group leisure play, with a central rotary closure which, as much as possible, is not present in preferred kicking areas of such shoes, for example, when opposing team members or teammates bump into each other, or a ball is to be kicked.

It is a further object of the invention to achieve the preceding object while still placing the central rotary closure in a location where it can be easily and conveniently operated.

These objects are achieved, in accordance with preferred embodiments of the invention, by providing the central rotary closure on an upper outer (lateral) side in an area surrounding the outside of the ankle. With the central rotary closure so located, advantageously, the tightening element runs from the central rotary closure, alternately between guide elements on the instep cover and lateral side part of the upper toward the toe area of the shoe, across the instep in the metatarsophalangeal joint area and then runs upwardly on the other (medial) side of the upper, alternating between guide elements on the instep cover and medial side part of the upper. The distal end of the tightening element may be attached to the upper material in the area of inner (medial) side of the ankle, or the tightening element can be run around the heel portion of the upper where the distal end of the tightening element may be returned to central rotary closure and attached to the upper in the area of the central rotary closure or is coupled with central rotary closure.

By the measure that the central rotary closure is placed in a more or less vertical plane on the outer side of the upper, it is very well protected against stresses occurring from above, as they occur in team ball games with numerous jumping actions. Nevertheless, the closure can still be easily operated by the user and it also does not interfere with wearing such a shoe or in the performance of sport or leisure exercises.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENTS

Figure 1:
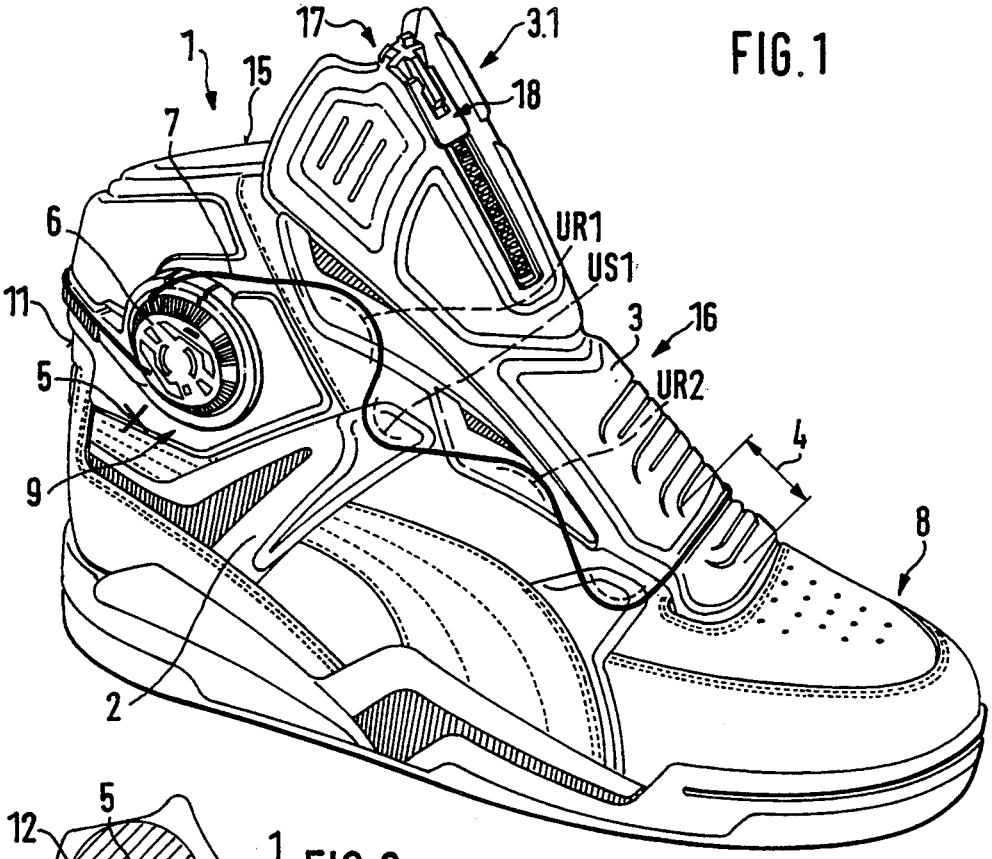
FIG. 1 is a perspective view of a sport shoe with a high top upper, as is used, for example, as a basketball shoe or as a volleyball shoe.

In FIG. 1, a shoe, designated generally by numeral 1, is provided with an upper having side parts 2, of which only one is visible, and with an instep cover 3 that is movable like a tongue or forms at least a part of it, and as used in this application, including the appended claims, the term "instep cover" is intended to encompass any of these possible forms. The instep cover 3 is connected to the material of the upper in the metatarsophalangeal joint area 4.

A central rotary closure 6 is provided on an upper portion 9 of the outer (medial) side part 2 of the upper, the outer side of the ankle 5 of the foot of a user being indicated by an "X".

A tightening element 7, for example, a wire or a rope made of plastic or metal, is permanently connected with central rotary closure 6. This tightening element 7 can be wound or unwound inside central rotary closure 6, in a known manner, and thus can be shortened or extended. Tightening element 7 runs, according to FIGS. 1 and 9–11, from central rotary closure 6, at the outside of upper portion 9 over a guide element UR1 on the instep cover 3, then over an upper guide element US1 on side part 2, then back to instep cover where it passes over lower guide element UR2, etc. as it travels toward the shoe tip 8. When the tightening element 7 reaches the bottom of the throat area of the upper, it crosses over to the inner (medial) side of the upper in metatarsophalangeal joint area 4, and runs from there, alternately over guide elements US and UR of medial side part 2 and instep cover 3 upward to the area of the medial side of the ankle 10 (see FIGS. 9 to 11).

Figure 9:
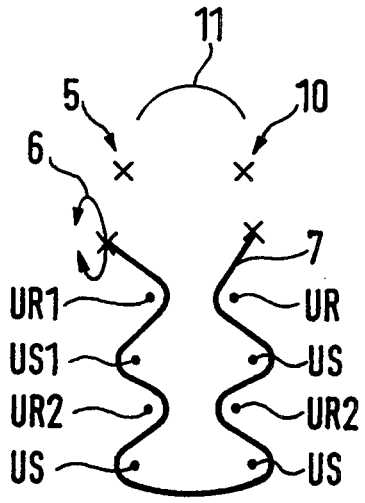
FIGS. 9 to 11 are respective diagrammatic representations of possible paths for the tightening element.
Figure 10:
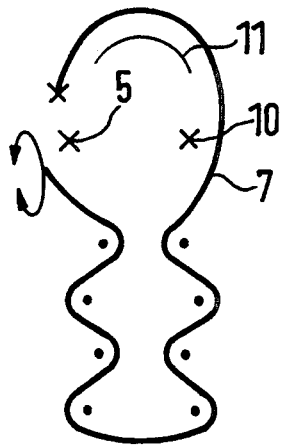

In the embodiment according to FIG. 9, tightening element 7 is attached to the upper in the area of the medial side of the ankle 10. In the diagram of the tightening path for tightening element 7 shown in FIG. 10, the tightening element runs around an upper section of the heel 11 of the upper and is attached to the material of the upper portion 9, preferably near the central rotary closure 6.

Figure 11:
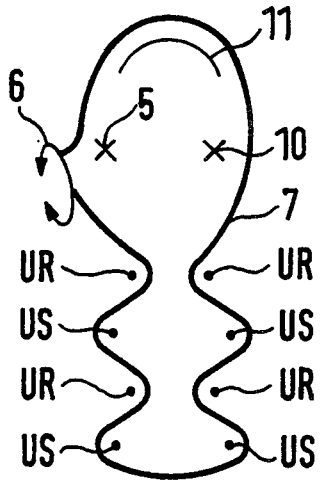

According to the tightening diagram shown in FIG. 11, and as shown in FIG. 1, the tightening element 7 is brought around the upper section of the heel 11 back to the central rotary closure 6 and is attached to it, and especially, is coupled in a tightenable manner with the winding element of the closure 6.

Figure 2:
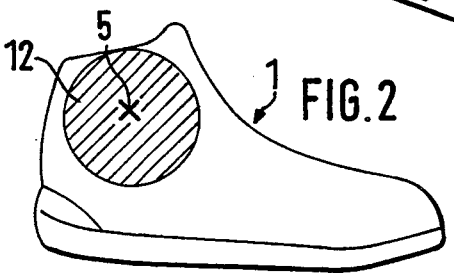
FIGS. 2 to 6 are diagrammatic representations of side views of a shoe showing different preferred zones for placement of the central rotary closure.
Figure 3:
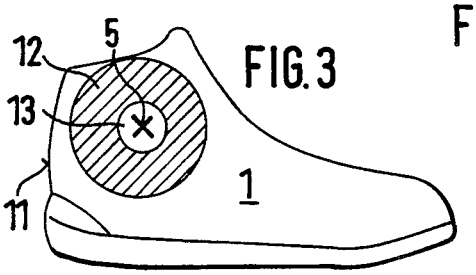

Central rotary closure 6 is provided in an area 12 surrounding the lateral side of the ankle 5, as indicated in FIG. 2 as an example. However, the central rotary closure is not located in the portion of area 12, designated 13 in FIG. 3, and which is in immediate proximity to the lateral side of the ankle 5, to avoid, as much as possible, or at least sufficiently minimize pressure on the lateral side of the ankle 5.

Figure 5:
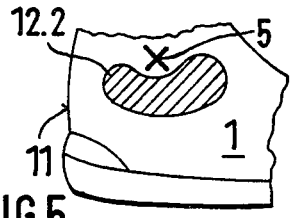
Figure 6:
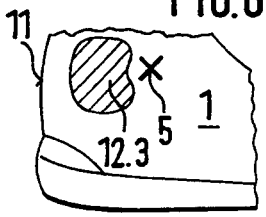
Figure 4:
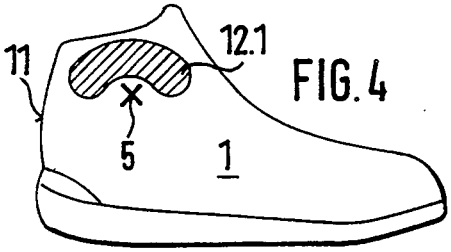

It can possibly be advantageous to provide the central rotary closure 6, as represented in FIG. 4, in the surrounding area section 12.1, which extends above the lateral side of the ankle 5, approximately between the heel of the upper 11 and the instep area, or to provide it in the area section 12.2 shown in FIG. 5 below the lateral side of the ankle 5. Optionally, central rotary closure 6 can suitably be provided in a surrounding area section 12.3 that is located between the lateral side of the ankle 5 and the heel of the upper 11, as is indicated in FIG. 6.

Figure 7:
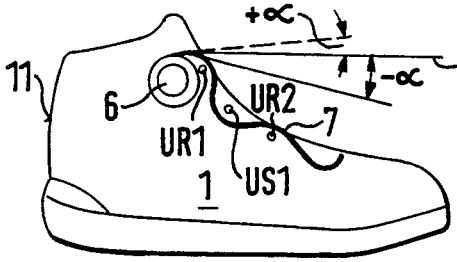
FIGS. 7 and 8 are diagrammatic representations of side views of a shoe illustrating the preferred angular orientation of the tightening element as it runs from the central rotary closure to the first guide element.
Figure 8:
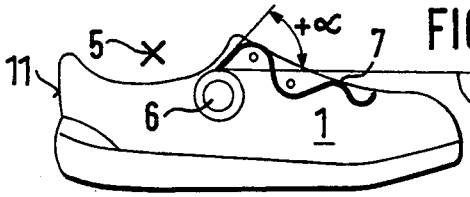

Central rotary closure 6 and the topmost guide element UR1 of instep cover 3 are placed, in the embodiments according to FIGS. 1 and 7, so that tightening element 7 runs from the central rotary closure 6 to this guide element in a generally horizontal plane 14 or at an angle $\pm\alpha$ of up to about 15°. In this way, a secure upper closure is obtained with a high top upper, and the tightening action is directed toward the heel 11 of the upper. For shoes with a low upper, as is represented in FIG. 8, the tightening element 7 runs from the central rotary closure 6 to the guide element UR1 at an angle $+\alpha$ of about 0° to 70° to horizontal plane 14. In this way, a good heel fit is assured. The tightening action can be directed to an area which, on the one hand, is between the heel 11 or a lower section of it and, on the other hand, is of the foot toward the metatarsal bone on the lateral side, or toward the arch of the foot on the medial side of the foot.

According to an advantageous further development of the invention, each topmost first guide element UR1 and the following guide element UR2 of instep cover 3 and the guide element US1 located between them on the side part 2 of the upper, are placed to produce a tightening effect, by winding of tightening element 7, that is in a direction toward the area of an upper section of heel 11 on the lateral side (i.e., to the metatarsal bone) and in a direction toward an area between the upper section of heel 11 and the arch of the foot at the medial side of the shoe.

Tightening element 7, while visible in heavy solid lines in the drawings, is preferably hidden, in a way known in the art, being extended through guideways, channels or the like.

As is known, a central rotary closure 6 can be used which has a quick-release disengaging device which, for example, releases by exerting pressure on the center of the disk of the central rotary closure.

In shoes with a long instep cover 3, especially where it projects above an upper edge of the shoe 15, the cover section 3.1 above the ankle joint 16 can be divided lengthwise. The optionally resulting separation 17 can be closed by a quick-release slot closure 18. In this way, a wide opening can be obtained above the ankle joint in shoes with a high top upper, so that putting on and taking off of the shoe are facilitated. Quick-release slot closure 18 can be, for example, a zipper (as shown in FIG. 1) or a sliding closure, or, with overlapping parts, a closure.

While various embodiments in accordance with the present invention have been shown and described, it is understood that the invention is not limited thereto, and is susceptible to numerous changes and modifications as are known to those skilled in the art. Therefore, this invention is not limited to the details shown and described herein, and includes all such changes and modifications as are encompassed by the scope of the appended claims.

I claim:

1. A shoe having an upper which is formed of an elastically flexible material at least in side parts thereof, an instep cover covering an instep of the foot, a tightening element which can be wound for closing the shoe and can be extended for opening it, and a central rotary closure coupled with the tightening element and mounted on an upper portion of a lateral side of one of the side parts in an area of the upper at which a wearer's ankle is received; wherein said tightening element acts on a portion of a throat area of the shoe extending from the central rotary closure toward a tip of the shoe being alternately guided, beginning with a guide element on the instep cover, between guide elements on the instep cover and respective guide elements of the lateral side of one of the side parts; across the instep in a metatarsophalangeal joint area to a medial side of one of the side parts where the tightening element runs upwardly and toward an upper heel area being alternately guided between guide elements on the medial side of one of the side parts and respective guide elements of the instep cover to an attaching point for a distal end thereof at the upper portion of the upper on one of the side parts thereof.

2. Shoe according to claim 1, wherein said tightening element extends around an upper part of a heel area of the upper and said attaching point is close to an ankle bone area of the upper without overlying the ankle bone area of the upper.

3. Shoe according to claim 2, wherein said distal end of the tightening element is coupled with the central rotary closure.

4. Shoe according to claim 2, wherein said distal end of the tightening element is attached to the upper at the lateral side thereof.

5. Shoe according to claim 1, wherein said distal end of the tightening element is attached to the upper at the medial side thereof.

6. Shoe according to claim 1, wherein the central rotary closure is provided above the lateral side of the ankle in an area between an upper heel section and an instep area.

7. Shoe according to claim 1, wherein the central rotary closure is provided below the lateral side of the ankle in an area between an upper heel section and an instep area.

8. Shoe according to claim 1, wherein the central rotary closure is provided in an area between the lateral side of the ankle and an upper heel section.

9. Shoe according to claim 1, wherein the upper has top portion with an ankle bone area; and wherein the central rotary closure and a topmost guide element of the instep cover are located relative to each other in a manner causing the tightening element to run from the central rotary closure to the topmost guide element at an angle of about $\pm 15°$ relative to a horizontal plane as a means for producing a tightening action of the tightening element that is directed toward a heel area of the upper.

10. Shoe according to claim 9, wherein guide elements below said topmost guide element on side areas of the instep cover and on the side parts of the upper are located at positions which cause them to coact with the tightening element to form a means for producing a tightening action of tightening element that is directed toward an area between an upper section of a heel area and an arch of the wearer's foot on a medial side of the upper and toward an area between the upper section of the heel area and the wearer's metatarsal bone at a lateral side of the upper.

11. Shoe according to claim 9, wherein said tightening element extends around an upper part of a heel area of the upper and said attaching point is close to said ankel bone area of the upper it; and wherein said distal end of the tightening element is coupled with the central rotary closure.

12. Shoe according to claim 9, wherein said tightening element extends around an upper part of a heel area of the upper and said attaching point is close to said ankle bone area of the upper without overlying it; and wherein said distal end of the tightening element is attached to the upper at the lateral side thereof.

13. Shoe according to claim 9, wherein said distal end of the tightening element is attached to the upper at the medial side thereof.

14. Shoe according to claim 1, wherein the upper terminates below an area of the upper at which a wearer's ankle bone is received; and wherein the central rotary closure and a topmost guide element of the instep cover are located relative to each other in a manner causing the tightening element to run from the central rotary closure to the topmost guide element at an angle of 0° up to about +70° relative to a horizontal plane as a means for producing a tightening action of the tightening element that is directed toward said heel area of the upper.

15. Shoe according to claim 14, wherein guide elements below said topmost guide element on side areas of the instep cover and on the side parts of the upper are located at positions which cause them to coact with the tightening element to form a means for producing a tightening action of tightening element that is directed toward an area between an upper section of a heel area and an arch of the wearer's foot on a medial side of the upper and toward an area between the upper section of the heel area and the wearer's metatarsal bone at a lateral side of the upper.

16. Shoe according to claim 15, wherein said tightening element extends around an upper part of a heel area of the upper and said attaching point is close to an ankle bone area of the upper without overlying it; and wherein said distal end of the tightening element is coupled with the central rotary closure.

17. Shoe according to claim 15, wherein said tightening element extends around an upper part of a heel area of the upper and said attaching point is close to an ankle bone area of the upper without overlying it; and wherein said distal end of the tightening element is attached to the upper at the lateral side thereof.

18. Shoe according to claim 15, wherein said distal end of the tightening element is attached to the upper at the medial side thereof.

19. Shoe according to claim 1, wherein the upper extends at least as high as an ankle area of the upper at which a wearer's ankle is received; wherein said instep cover has a portion that extends above the ankle area, said portion of the instep cover being divided lengthwise to create a slot-like opening therein; and wherein a slot quick-release slot closure is provided for closing and opening of the slotlike opening.

20. Shoe according to claim 19, wherein the slot closure is in the form of a zipper.

21. Shoe according to claim 19, wherein said portion of the instep cover projects upwardly at least partially over a top edge of the upper.

* * * * *